United States Patent [19]

Fry

[11] Patent Number: 4,767,562

[45] Date of Patent: Aug. 30, 1988

[54] ENZYMATIC LIQUID DETERGENT COMPOSITION

[75] Inventor: Alan J. Fry, Ellesmere Port, Great Britain

[73] Assignee: Lever Brothers Company, New York, N.Y.

[21] Appl. No.: 937,260

[22] Filed: Dec. 3, 1986

[30] Foreign Application Priority Data

Dec. 6, 1985 [GB] United Kingdom ..... 8530188

[51] Int. Cl.[4] ..... C11D 3/28; C11D 3/34; C11D 3/386; C11D 3/48

[52] U.S. Cl. ..... 252/174.12; 252/542; 252/DIG. 12; 252/DIG. 14; 435/188

[58] Field of Search ..... 252/174.12, DIG. 12, 252/DIG. 14, 524, 542; 435/188; 514/372; 548/148

[56] References Cited

U.S. PATENT DOCUMENTS

| | | | |
|---|---|---|---|
| 4,142,999 | 3/1979 | Blocking et al. | 252/DIG. 12 |
| 4,252,694 | 2/1981 | Lewis et al. | 252/526 |
| 4,499,071 | 2/1985 | Borovian | 514/372 |
| 4,566,985 | 1/1986 | Bruno et al. | 252/174.12 |
| 4,602,011 | 7/1986 | West et al. | 514/187 |
| 4,661,503 | 4/1987 | Martin et al. | 514/634 |

*Primary Examiner*—Paul Lieberman
*Assistant Examiner*—Kathleen Markowski
*Attorney, Agent, or Firm*—James J. Farrell; Matthew J. McDonald

[57] ABSTRACT

The invention relates to an aqueous, enzymatic liquid detergent with improved enzyme stability. By inclusion of a specific type of preservative of the isothiazolinone type, the rate of enzyme deactivation is significantly retarded.

1 Claim, No Drawings

ENZYMATIC LIQUID DETERGENT COMPOSITION

The present invention relates to an aqueous enzymatic liquid detergent composition with improved storage stability of the enzymes contained therein.

It is well known in the art that enzymes can lose their activity over a certain period when included in an aqueous liquid detergent composition, and various proposals have already been made to retard that loss of activity by including in such compositions an enzyme-stabilizing system.

We have now surprisingly found that the inclusion of a certain class of preservatives in such aqueous enzymatic liquid detergent compositions also retards the loss of enzyme activity.

Since preservatives are compounds which either kill or inhibit the growth of microorganisms, one would expect such preservatives either to be indifferent to the enzymes or to effect them negatively, depending upon their chemical constitution. In contrast thereto, we found quite unexpectedly that a certain class of preservatives has a positive influence on the enzyme activity in that they significantly retard the rate of enzyme deactivation.

This specific class of preservatives embraces the compounds having an isothiazolinone backbone in their molecule. Typical examples of such compounds are 1,2-benzisothiazolin-3-one, 5-chloro-2-methyl-4-isothiazolin-3-one, 2-methyl-4-isothiazolin-3-one.

We have found that the inclusion of a small amount of these preservatives, in the range of 0.001–0.1% by weight of the total detergent composition, significantly retarded the enzyme deactivation.

The present invention therefore relates to an aqueous enzymatic liquid detergent composition with an improved storage stability of the enzymes contained therein, the improved storage stability being obtained by the inclusion in the composition of 0.001–0.1% of a preservative having an isothiazolinone backbone in its molecular structure.

The enzymatic liquid detergent composition of the present invention contains as essential ingredients a detergent-active component and enzymes.

The detergent-active component can be either soap, anionic, nonionic, cationic or zwitterionic synthetic detergents and mixtures of one or more of these detergent-active components.

Preferably a nonionic synthetic detergent is used, either as such or in admixture with a cationic detergent-active component.

Usually, the total amount of detergent-active component(s) ranges from 5–70, preferably from 10–40% by weight of the total composition.

The enzymes that can be used in the present invention are proteases, amylases, lipases, cellulases and mixtures of one or more of these enzymes. Proteases are preferred enzymes for use in the present invention. The amount of enzymes present in the composition may range from 0.001–10% by weight.

The composition may furthermore contain other optional ingredients such as perfumes, colouring materials, soil-suspending agents, other enzyme-stabilizing agents, builders, bleaching agents, bleach precursors, hyrotropes, solvents, suspending agents suds suppressors etc.

The invention will be further illustrated by way of Example.

EXAMPLE

The following formulation was prepared:

| | % by weight |
|---|---|
| $C_{13}$–$C_{15}$ primary linear alcohol, condensed with 7 moles of ethylene oxide | 15.0 |
| di(soft tallow) dimethylammonium chloride | 1.5 |
| industrial methylated spirit | 5 |
| propylene glycol | 5 |
| borax decahydrate | 1.5 |
| perfume | 0.25 |
| colour | 0.001 |
| protease (Alcalase ® ex Novo) | 0.34* |
| preservative | x |
| demineralized water | to 100%. |

*Corresponds to a proteolytic activity of 6 glycine units per milligramme.

1,2-Benzisothiazolin-3-one was included as preservative, at various concentrations and the residual enzyme activity determined after storage at 37° C. for four weeks. For comparison purposes; the formulation without any preservative as well as with 0.075% formaldehyde were also included in the tests.

The following results were obtained:

| | Enzyme activity (in GU/mg) | |
|---|---|---|
| Formulation | Initial | After 4 weeks at 37° C. |
| Control (no preservative) | 5.9 | 2.5 (42% remaining) |
| +0.003% 1,2-benzisothiazolin-3-one | 5.9 | 2.8 (47% remaining) |
| +0.0165% 1,2-benzisothiazolin-3-one | 5.7 | 3.5 (61% remaining) |
| +0.03% 1,2-benzisothiazolin-3-one | 5.8 | 4.3 (74% remaining) |
| +0.075% formaldehyde | 5.4 | 1.7 (31% remaining) |

I claim:

1. An enzymatic liquid detergent composition comprising from 5–70% by weight of a detergent-active material selected from the group consisting of soaps, anionic, nonionic, cationic, zwitterionic synthetic detergents and mixtures thereof and from 0.001–10% by weight of an enzyme selected from the group consisting of proteases, amylases, lipases, cellulases and mixtures thereof, and from 0.001–0.1% by weight of 1,2-benzisothiazolin-3-one, the balance being an aqueous medium.

* * * * *